United States Patent [19]

Froman et al.

[11] 3,959,099

[45] May 25, 1976

[54] ELECTROLYTIC METHOD OF PRODUCING ONE-SIDE-ONLY COATED STEEL

[75] Inventors: Griff W. Froman, St. John; Brian A. Sok, East Chicago; Lenin F. Martinez, Hammond; Albert R. Mullins, Portage, all of Ind.

[73] Assignee: Inland Steel Company, Chicago, Ill.

[22] Filed: June 18, 1975

[21] Appl. No.: 587,816

[52] U.S. Cl. ..... 204/146; 204/211; 204/231

[51] Int. Cl.[2] ..... C25F 5/00

[58] Field of Search ..... 204/146, 231, DIG. 7, 204/129.1, 129.75, 211

[56] References Cited

UNITED STATES PATENTS

| | | | |
|---|---|---|---|
| 3,178,305 | 4/1965 | Ward | 204/146 |
| 3,394,063 | 7/1968 | Blume | 204/146 |
| 3,511,758 | 5/1970 | Bedi | 204/231 |
| 3,901,771 | 8/1975 | Froman et al. | 204/DIG. 7 |

*Primary Examiner*—T. M. Tufariello
*Attorney, Agent, or Firm*—Hibben, Noyes & Bicknell, Ltd.

[57] ABSTRACT

A process of making a one-side-only coated endless metal sheet in which a sheet initially having a protective metal coating, such as zinc, on both lateral surfaces thereof is subjected to an electrolytic treatment which removes the protective metal coating from only one side of the metal sheet by continuously passing the metal sheet through an electrolytic treating chamber containing as an electrolyte bath a strongly acidic aqueous solution, such as sulfuric acid, having a pH from about pH 0.1 to 2.0, and preferably about pH 1.0, or a strongly alkaline aqueous solution, such as sodium hydroxide, having a pH of at least about pH 11 and preferably above pH 11, with said metal sheet being guided between spaced anodic and cathodic electrodes immersed in said electrolyte bath so as to establish a cathodic current between said anodic electrode and the adjacent surface of said metal sheet which is made cathodic and establishing an anodic current from a second rectifier between said cathodic electrode and the adjacent surface of said metal sheet which is made anodic, and maintaining the anodic current at a current density level so as to maintain the surface of said metal sheet which is to remain coated completely cathodic and effects complete removal of said protective metal coating from the anodic surface during the period said sheet remains in said electrolytic treating chamber, and with the cathodic current maintained at a current density level below said anodic current density level but sufficiently high to neutralize the E.M.F. generated when the said protective metal coating is immersed in said electrolyte bath.

8 Claims, 1 Drawing Figure

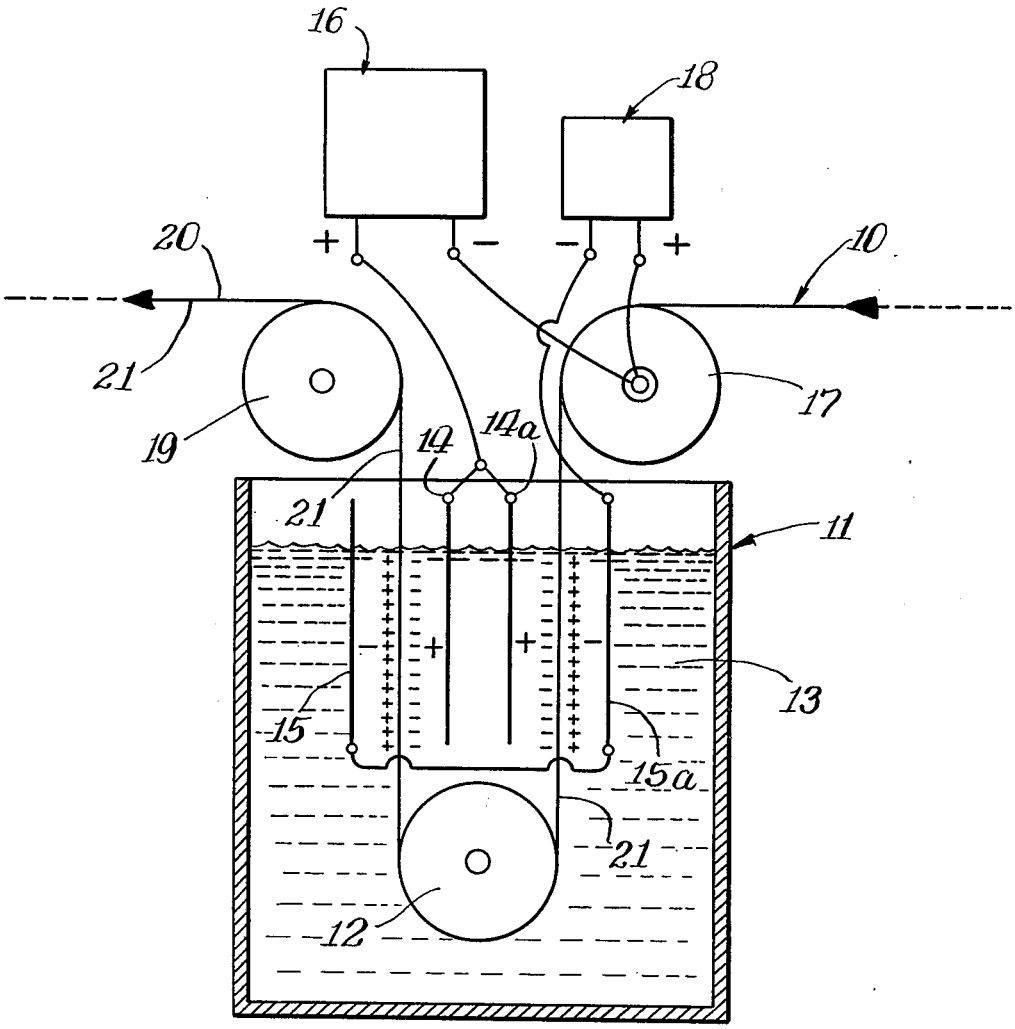
16
18
20
10
21
17
19
14
14a
21
11
13
15
15a
21
12

ELECTROLYTIC METHOD OF PRODUCING ONE-SIDE-ONLY COATED STEEL

The present invention relates generally to a sheet metal product having a protective metal coating, and more particularly to an improved electrolytic method of making a sheet steel product having a protective metal coating on only one surface thereof.

Metal articles, particularly ferrous metal sheets or strips, are often coated with a protective metal to prevent corrosion of the ferrous metal on exposure to a corrosive atmosphere or other corrosive conditions. The need for coating a ferrous metal sheet on only selected portions thereof has become of increasing importance in connection with the manufacture of automobile bodies, since it is desirable to protect the under surface of an automobile body against corrosion while the outer surface must be receptive to paint or enamels and capable of being readily welded. Since the portion of a ferrous metal surface coated with a protective metal material, such as zinc, is not readily painted and cannot be readily welded, it is highly desirable to provide a process for coating only selected portions of a ferrous metal article with a protective metal while leaving other portions of the ferrous metal free of the protective metal coating.

Among the processes which have heretofore been developed for producing a sheet steel product coated on only one side is an electrolytic process described in U.S. Pat. No. 3,178,305 wherein a steel strip is zinc coated on both sides, as by hot-dip coating, and thereafter the zinc is removed from one side of the strip electrolytically by continuously passing the strip through an electrolyte cell containing a mildly acidic solution of zinc salts and having a cathodic electrode mounted within the cell with one surface of the strip adjacent the cathodic electrode being made anodic so that the coating on this surface of the strip is removed. In the latter process, however, some of the zinc is also removed from the opposite surface of the strip which should remain coated and an objectionable variation in the uniformity of the zinc coating on the one-side-coated surface results, particularly along the edge portions of the strip due to the anodic or reverse "wrap-around" effect of the anodic current.

Accordingly, it is an object of the present invention to provide an improved process of producing a one-side-only coated sheet metal product.

It is a further object of the present invention to provide an improved process of producing a steel sheet product having a protective metal coating on only one surface thereof in which the protective metal coating material is removed electrolytically from only one surface of a steel sheet initially having a protective metal coating on both surfaces thereof.

It is still another object of the present invention to provide an improved process of producing a one-side-only galanized steel sheet in which the zinc is completely removed electrolytically from only one flat surface of a steel sheet having a hot-dip coating on both surfaces thereof. galvanized Other objects of the present invention will be apparent to those skilled in the sheet metal coating art from the following detailed description and claims when read in conjunction with the accompanying drawing showing a longitudinal vertical sectional view of an electrolytic cell schematically showing the electrical system used in the present invention.

In achieving the objects of the present invention a clean elongated metal sheet or strip, such as an endless steel strip suitable for continuous galvanizing, which has been coated in any conventional manner to provide a protective metal coating on both surfaces, as by hot-dip coating, spraying, cladding, or by electrolytically coating in any suitable manner, preferably having a protective metal coating of reduced thickness relative to the protective metal coating on the opposite surface of the sheet as by differentially hot-dip coating, is treated in an electrolytic cell or chamber containing an electrolyte bath, preferably a strongly acidic or strongly alkaline aqueous electrolyte solution or a concentrated salt solution, and by passing the metal sheet between an anodic electrode and a cathodic electrode. The anodic electrode is disposed adjacent and directly facing the surface of the sheet which is to remain coated, and the cathodic electrode is disposed adjacent and directly facing the surface of the sheet from which the protective metal must be removed. The anodic electrode is connected with the positive terminal of a suitable first source of direct current and the negative terminal thereof is electrically connected with the metal sheet. The cathodic electrode is connected with the negative terminal of a second independent source of direct current and the positive terminal thereof is electrically connected with the metal sheet. A cathodic current is established by the flow of current through the electrolyte between the proximate surface of the metal sheet and the anodic electrode, making the latter surface completely cathodic. An anodic current flowing between the cathodic electrode connected to the second source of direct current and the surface of the metal sheet directly facing the cathodic electrode makes the latter surface anodic. By maintaining the anodic current at a suitable current density level ions of the protective metal coating are withdrawn from the anodic surface of the sheet and go into solution in the electrolyte bath effecting complete removal of the protective coating from the latter surface of the sheet during the time the sheet is immersed in the electrolyte. The cathodic current is maintained at a current density level which holds the positively charged ions of the protective metal coating on the negatively charged cathodic surface of the metal sheet. And, contrary to the usual cathodic electroplating practice, by maintaining the current levels and composition of the electrolyte bath in accordance with the present disclosure it is possible to avoid having metal ions depositing on the cathodic surface of the metal sheet and on the cathodic electrode.

In order to provide a process for the continuous production of one-side-only coated sheet material which is suitable for use with auxiliary apparatus normally used in conjunction with a conventional continuous hot dip coating line or other continuous strip treatment wherein the rate of travel of the metal sheet through a processing step limits the treating time in the electrolyte bath to a maximum period of between about 10 and 15 seconds, it has been found desirable to use as the electrolyte bath an aqueous acidic or aqueous alkaline bath which has a relatively high concentration of a strong acid or a strong alkaline material. The more concentrated the electrolyte the faster the coating can be electrolytically removed with a given anodic current density. Thus, when the protective coating material is a metal which is readily or preferentially soluble in an aqueous acidic solution, such as metallic zinc or nickel, the electrolyte bath can be formed of an aqueous solution of one of the strong inorganic acids, such as sulfuric acid, hydrochloric acid, nitric acid, chromic acid, or phosphoric acid, preferably having a concentration which ranges between about 5 and 20% by wt. of the electrolyte and preferably maintaining the pH at about pH 1.0, although the pH can be as low as 0.1 and as high as 2.0. When the protective coating metal is a metal which is readily or preferentially soluble in an alkaline aqueous solution, such as zinc, chromium, tin or lead, an aqueous solution of a strong alkaline material, such as an alkali metal hydroxide or an alkali earth metal hydroxide can be used in an amount sufficient to provide a pH of at least about pH 11 and preferably above about pH 11.

Where a strongly acidic or strongly alkaline electrolyte solution is used as the electrolyte bath, there is a tendency for the protective metal coating which should remain on the cathodic side of the steel sheet, even in the absence of the applied anodic current, to be attacked by the strong electrolyte solution and cause some of the protective metal on the one-side-coated surface to go into solution, particularly along the edge portions of the strip as a result of the "wrap-around" effect of the anodic current. These highly objectionable influences of the concentrated electrolyte solution and the anodic current wrap-around effect have been overcome in the process of the present invention, however, by maintaining the cathodic current from the first source of direct current at a current density level which maintains the entire surface sufficiently cathodic to hold the ions of the protective metal on the surface of the steel sheet, while simultaneously maintaining the anodic current from the independent second source of direct current at a sufficient high level to completely remove the protective metal coating from the side of the steel sheet facing the cathodic electrode during passage of the continuously moving strip through the electrolytic cell. Thus, for example, when treating a hot-dip galvanized steel sheet applying a cathodic current having a current density less than about 300 amps per square foot is insufficient to prevent some zinc ions being removed from the cathodic surface of a steel sheet immersed in a 10% by wt. sulfuric acid electrolyte solution, because a reverse current or electromotive force (E.M.F.) of 300 amps per square foot is generated when a zinc coated surface is immersed in a 10% by wt. aqueous sulfuric acid solution. It is therefore critical to maintain the cathodic current at a level at least sufficient to neutralize the E.M.F. generated when the protective metal coating is immersed in the electrolyte bath and preferably slightly larger than this deplating or reverse current which is generated. Each protective metal surface will generate a particular E.M.F. when immersed in a specific electrolyte bath which will have to be "neutralized" by the cathodic current applied.

The cathodic current density level plays a further important part in maintaining the one-side-coated surface of the sheet uniformly coated with the protective metal while the protective metal coating on the opposite surface of the sheet is completely removed without requiring the use of special shields or sealing means to partition the electrolyte bath. Thus, the magnitude of the cathodic current must also be adjusted so as to eliminate the anodic wrap-around effect on the cathodic side of the metal sheet. For example, if there were no cathodic current used in accordance with the prior art processes, the anodic wrap-around effect on the cathodic surface of the sheet which should remain uniformly coated with protective metal would result in removal of the protective coating metal along a strip about ½ inch wide extending inwardly from the lateral edges of the sheet and extending the entire length of the sheet. The foregoing wrap-around effect can be overcome, however, by applying sufficient cathodic current to maintain the entire surface cathodic and using an electrolytic bath composition as herein described. When the anodic current density level is increased, the cathodic current density level required to prevent the wrap-around effect must also be increased proportionately.

An important factor in determining the anodic current density level used in a specific application of the present process is the period of time within which the zinc coating must be removed, and this is largely determined by the average line speed of the sheet, as this speed determines the time the sheet will remain in the electrolyte bath. The higher the anodic current density the faster the zinc coating will be removed from the anodic side of the metal sheet during immersion in a particular electrolyte bath composition. The time limitation imposed when treating a continuously moving coated ferrous metal sheet necessitates having the anodic current density level relatively high and must at all times be greater than the level of the cathodic current being applied. For example, when an anodic current density of about 1000 ASF (24 Volts) is applied, it is feasible to remove from one surface of a steel strip a hot-dip zinc coating having a thickness of about 0.15–0.25 mils within a minimum of 10 seconds and a maximum of about 15 seconds in a 10–15% by wt. sulfuric acid aqueous electrolyte bath by the process of the present invention.

In general it has been found best to maintain the ratio of the anodic current density to cathodic current density at about 2:1. The anodic current preferably is maintained at about 1000 ASF when treating a hot-dip coated zinc plated steel sheet in a 10–15% sulfuric acid aqueous bath. And, although improved results over prior art procedures are obtained in the above treatment of the hot-dip galvanized sheet when the cathodic current density level is maintained between about 300–800 ASF with the anodic current density level at about 1000 ASF, best results are obtained when the cathodic current density level is 500 ASF. In one side zinc coating the one-side-only zinc coating remaining on the metal sheet after removal of the coating on the other side will have an objectionable dark appearance, if the anodic current and cathodic current density levels approach a 1:1 ratio. Thus, the use of a current density ratio approaching 1:1 or a ratio lower than 1:1 is to be avoided.

A one-side-only copper coated steel strip has been prepared by the process of the present invention using an aqueous electrolyte bath comprised of 250 grams per liter of chromic acid.

One-side-only chromium, tin, lead and zinc coated steel strips have also been produced by the process of the present invention using an aqueous electrolyte bath comprising 100 grams per liter of sodium hydroxide.

A one-side-only nickel coated steel strip has been produced by the process of the present invention using an aqueous electrolyte bath comprised of 360 grams per liter of sodium nitrate.

In addition to the foregoing electrolyte bath compositions any of the solutions for stripping plated metal coatings set forth in Table 14 in "Principles of Electroplating" by Blum and Hogaboom, Third Ed., 1949, McGraw-Hill Book Company, can be used as the electrolyte bath in the process of the present invention.

An illustration of an apparatus suitable for carrying out the process of the present invention is shown in the accompanying drawing wherein a cold rolled low carbon thin endless steel sheet 10 which has been continuously hot-dip galvanized and provided with a galvanized differential coating having a thickness of about 0.9 mils on the upper surface 20 and a thickness of about 0.2 mils on the opposite or lower surface 21, after passing through a conventional spray chamber (not shown) to solidify the hot-dip coating, is conducted into an electrolytic treating tank or chamber 11 over an inlet conductor roll 17 and downwardly into the electrolyte bath 13 around a sink roll 12 and upwardly over an exit roll 19. Spaced anodic electrodes 15, 14*a* and cathodic electrodes 15, 15*a*, respectively, are maintained in the electrolyte bath 13 on opposite sides of the sheet 10, such that the upper surface 20 of the strip which is to remain coated only faces the anodic electrodes 14, 14*a* and the cathodic electrodes 15, 15*a* are disposed in the bath 13 facing the lower side 21 from which the protective metal coating is to be removed during passage of the sheet through the chamber 11. Each of the electrodes is spaced from the sheet 10 sufficiently to allow free circulation of the electrolyte bath within the electrolytic chamber 11 so as to maintain a uniform composition throughout. The anodic electrodes 14, 14*a* are connected with the positive terminal of a first source of direct current, such as a rectifier 16, with the negative terminal of the first source of direct current being connected with the inlet roll 17 which is adapted to form an electrical contact with the metal sheet 10. The cathodic electrodes 15, 15*a* are connected with the negative terminal of a second source of direct current, such as rectifier 18, with the positive terminal of the second source of direct current also connected with the inlet roll 17 which is adapted to form an electrical contact with the metal strip 10. The anodic and cathodic electrodes are preferably formed of lead, carbon or like electrically conductive material inert toward the electrolyte, the electrodes do not have to have a width equal to each other or to the width of the metal strip being electrotreated. The sink roll 12 and the exit roll 19 are formed of electrical insulating material.

We claim:

1. In a method of making a one-side-only coated endless metal sheet material in which the sheet has initially a protective metal coating on both lateral surfaces thereof and is subjected to an electrolytic treatment which removes the protective metal coating from only one side of the metal sheet, the improvement comprising: continuously passing the metal sheet having said protective metal coating on both lateral surfaces thereof through an electrolytic treating chamber containing an electrolyte bath selected from the group consisting of (1) a strongly acidic aqueous solution having a pH from about pH 0.1 to 2.0 and (2) a strongly alkaline aqueous solution having a pH of at least about pH 11, said metal sheet being guided between spaced anodic and cathodic electrodes immersed in said electrolyte bath, said anodic electrode being disposed adjacent the surface of the metal sheet which remains coated with said protective metal and said cathodic electrode being disposed adjacent the surface of the metal sheet from which said protective metal coating is removed, establishing a cathodic current from one source of direct current through said electrolyte bath between said anodic electrode and the surface of said metal sheet closest thereto, establishing an anodic current from a second source of direct current through the electrolyte bath between said cathodic electrode and the surface of said metal sheet closest thereto, maintaining said anodic current at a current density level which maintains the surface of said metal sheet which is to remain coated completely cathodic and effects complete removal of said protective metal coating from the anodic surface during the period said sheet remains in said electrolytic treating chamber, and maintaining the said cathodic current at a current density level below said anodic current density level and at a level sufficient to neutralize the E.M.F. generated when the said protective metal coating is immersed in said electrolyte bath and maintain the surface of said metal sheet from which the protective metal is removed completely anodic; whereby removal of protective metal from said one side of said sheet is prevented while the said protective metal coating on the opposite side of said sheet is completely removed.

2. A method as in claim 1, wherein said metal sheet has a protective metal coating which is preferentially soluble in an aqueous solution of a strong inorganic acid, and said electrolyte bath is comprised of between about 5 and 20% by weight of a strong inorganic acid.

3. A method as in claim 2, wherein the said inorganic acid is selected from the group of acids consisting of sulfuric hydrochloric, nitric, chromic and phosphoric.

4. A method as in claim 1, wherein said sheet has a protective metal coating which is preferentially soluble in an aqueous alkaline solution, and said electrolyte bath is selected from the group consisting of an alkali metal hydroxide, alkali metal salt, an alkali earth metal hydroxide, and an alkali earth metal salt.

5. A method as in claim 1, wherein said cathodic current is established by connecting said anodic electrode to the positive terminal of said one source of direct current and having the negative terminal of said one source in electrical contact with said metal sheet, and said anodic current is established by connecting said cathodic electrode to the negative terminal of said second source of direct current and having the positive terminal of said second source in electrical contact with the said metal sheet.

6. A method as in claim 1, wherein the said current density level of said anodic current and said current density level of said cathodic current have a ratio of about 2:1.

7. A method as in claim 1, wherein said metal sheet is a galvanized steel sheet having a zinc coating on both lateral surfaces with a coating thickness on at least one of the surfaces not exceeding about 0.25 mils and said electrolyte bath comprising a 10–15% by wt. sulfuric acid aqueous solution, having a pH of about 1.0, said current density level of said anodic current being maintained at about 1000 amps. per square foot and the current density level of said cathodic current being is maintained at about 500 amps. per square foot, and subjecting said metal strip to teach said anodic and cathodic currents simultaneously while said strip remains in said electrolyte for a period of 10–15 seconds; whereby said zinc coating on said one surface having a thickness not exceeding about 0.25 mls is completely removed from said metal strip without altering the thickness of the protective zinc coating on the opposite surface thereof.

8. A method as in claim 1, wherein the said metal sheet has a protective coating on both lateral surfaces selected from the group consisting of said electrolyte bath comprising an aqueous solution having a pH of at least about pH 11.

* * * * *